US005577958A

United States Patent [19]

Kumekawa et al.

[11] Patent Number: 5,577,958

[45] Date of Patent: Nov. 26, 1996

[54] WIND DIRECTION ADJUSTING DEVICE

[75] Inventors: Eriko Kumekawa, Kanagawa; Satoru Kotoh; Hiroaki Ishikawa, both of Hyogo; Takayuki Yoshida, Kanagawa; Yasuo Sone; Katsutoshi Nishikawa, both of Shizuoka, all of Japan

[73] Assignee: Mitsubishi Denki Kabushiki Kaisha, Tokyo, Japan

[21] Appl. No.: 531,005

[22] Filed: Sep. 20, 1995

[30] Foreign Application Priority Data

Sep. 26, 1994 [JP] Japan ..... 6-229742

[51] Int. Cl.[6] ..... F24F 13/072

[52] U.S. Cl. ..... 454/233; 454/301; 454/302; 454/304

[58] Field of Search ..... 454/230, 233, 454/234, 302, 304, 305, 312, 313, 321

[56] References Cited

FOREIGN PATENT DOCUMENTS

| | | | |
|---|---|---|---|
| 59-161636 | 9/1984 | Japan | 454/313 |
| 61-122447 | 6/1986 | Japan | 454/304 |
| 62-5044 | 1/1987 | Japan . | |
| 62-10555 | 1/1987 | Japan | 454/313 |
| 62-13579 | 3/1987 | Japan . | |
| 63-286648 | 11/1988 | Japan . | |
| 1-54168 | 3/1989 | Japan | 454/313 |
| 1-18340 | 4/1989 | Japan . | |
| 2-59379 | 12/1990 | Japan . | |
| 4-85047 | 7/1992 | Japan . | |
| 6-28517 | 4/1994 | Japan . | |
| 2056051 | 3/1981 | United Kingdom . | |

*Primary Examiner*—Harold Joyce

*Attorney, Agent, or Firm*—Oblon, Spivak, McClelland, Maier & Neustadt, P.C.

[57] ABSTRACT

A wind direction adjusting device includes a wind speed uniforming unit provided upstream of a wind path having a nonuniform wind speed distribution from the side of high wind speed to the side of low wind speed, and a blow-off opening provided downstream of the wind path, which includes a wind direction deflecting plate for deflecting the blow-off direction of the blown-off wind. Further, the wind speed uniforming unit includes a deflecting guide provided on a wind path wall on the side of the high wind speed for deflecting blown-off wind toward a wind path center portion; a wind path wall portion on the side opposite deflecting guide, the shape of which is changed in accordance with the shape of the deflecting guide so that the sectional area of the wind path is substantially uniform; and an enlarged wind path portion provided immediately after the downstream side end portion of the deflecting guide, the enlarged wind path portion serving to return the blown-off wind from the wind path center portion to the wind path wall downstream the deflecting guide on the side of the deflecting guide.

12 Claims, 7 Drawing Sheets

WIND DIRECTION ADJUSTING DEVICE

BACKGROUND OF THE INVENTION

1. Field of the Invention

The present invention relates to a wind direction adjusting device of an air conditioner.

2. Description of the Related Art

FIGS. 12 to 14 relate to the conventional ceiling-embedded cassette type air conditioner and its blow-off opening portion which is disclosed in e.g., Unexamined Japanese Utility Model Publication No. Hei. 6-28517. FIG. 12 is a longitudinal sectional view of the ceiling embedded cassette type air conditioner equipped with a glazed panel, and FIGS. 13 and 14 are longitudinal sectional views of a blow-off opening portion of the decoration panel.

In these figures, reference numeral 4 denotes a decoration panel attached to the lower surface of an air conditioner unit body 2. An opening portion 3 of a ceiling 1 is covered with the decoration panel 4. Reference numeral 5 denotes an sucking opening portion provided at a center portion of the decoration panel 4. Reference numeral 6 is one of blow-off opening portions provided on both sides of the decoration panel 4. Reference numerals 7 and 8 denote blower and a heat exchanger, respectively which constitute a unit body 2. The unit body 2 is secured to a hanger bolt 22 through hanging metal fittings 21 provided on the side of the unit body 2.

FIGS. 13 and 14 are enlarged views of the structure of a blow-off opening portion 6 provided on the decoration panel 4. In these figures, reference numeral 13 denotes a wind direction deflecting plate provided in a wind path 10 for deflecting blown-off wind vertically. The outer wall 18A of the wind path 10 is formed along a direction 23 making an angle $\alpha$ with a horizontal blowing direction PO1 and its longitudinal section is linear. The angle $\alpha$ has a sign of + when counterclockwise rotation is formed around a direction vertical to paper and is set at an angle of 5° or less.

An explanation will be given of the operation of the conventional air conditioner. In the conventional air conditioner, the blow-off opening portion is structured as described above. In operation, when the blower 7 is driven, the air in the room is sucked from the sucking opening portion 5. The sucked air is cooled during cooling and heated during heating by the heat exchanger 8. The cooled or heated air blows off from the blow-off opening portion 6 into the room along the wind path 10. The vertical direction of the blown-off wind is adjusted by the wind direction adjusting plate 13. With reference to the plane in parallel to the ceiling plane 1, the blow-off angle of 40° is set at a horizontal blowing PO1 and that of 60° is set at downward blowing PO4. The angle of horizontal blowing PO1 is a critical angle where the blowing wind does not flow along the decoration panel 4 and the ceiling plane 1. The angle of the downward blowing PO4 corresponds to the direction of the path of the blow-off opening portion 6.

During a cooling operation, when the blow-off angle is set at the horizontal blowing PO1 where the blown-off wind is separated from the ceiling 1, a portion 24 of the cooled air blown off flows along the outer wall 18 and goes out from the blow-off opening portion 6. The air advances along the outer lower surface 4A of the glazing panel while being mixed with indoor air 19. On the ceiling plane 1 at the end of decoration panel 4, the blown-off cooled air 24 merges with the indoor air 19. At this point, the temperature of the blown-off cooled air 24 has become higher than immediately after it has gone out from the blow-off opening portion 6, thereby preventing condensation because the indoor air 19 does not become lower than the dew point temperature.

If the wind direction deflecting plate 13 is set in the horizontal blow-off direction PO1 as shown in FIG. 14, the distance between the inner wall 18B of the blow-off opening portion and the rear end of the wind deflecting plate 13 becomes short so that the resistance against the wind path will be increased. Thus, the amount of wind flowing between the inner wall 18 of the blow-off opening portion and the wind direction deflecting plate 13 will be reduced. As a result, high-temperature and high-humidity indoor air 19 will be involved in the blow-off opening portion so that it flows in contact with the negative pressure side of the wind direction deflecting plate 13. Thus, owing to the heat conduction from the pressure side of the wind deflecting plate cooled by the blown-off wind, the temperature of the negative pressure side will become a dew point or lower, thus generating condensation.

In the conventional wind direction adjusting device, which is structured as described above, the wind speed distribution in the wind path 10 is not uniform. Since the wind path 10 is bend at right angles, under the influence of centrifugal force, the wind speed becomes higher at a more outer side of the unit body. Thus, the flow reaches the blow-off opening portion 6 along the wind path wall on the outer wall side by the Coanda effect. In this case, even if the wind direction deflecting plate intends to deflect the wind direction, since the deflecting direction of the flow is influenced by the side of the higher wind speed, it is restricted by the shape of the wind path wall along which the flow at a higher wind speed goes. This hinders the controllability of wind direction from being enhanced.

Because the wind speed at the blow-off opening portion distributes toward the side of the outer wall, the amount of wind directed to the side of the inner wall decreases and the blown-off flow does not almost flow toward the negative pressure side of the wind direction deflecting plate 13. In this state, when the blow-off angle is set to the horizontal blowing of PO1 during cooling, the direction of the wind direction deflecting plate 13 is greatly deflected from the direction of the wind path in the blow-off opening portion 6. Thus, the blown-off air flow at the negative pressure side of the wind direction deflecting plate is separated to involve high-temperature high-humidity indoor air 19. Further, since the wind deflecting plate 13 is cooled to the due point or lower by the cooled air abutting on the pressure surface side of the wind direction deflecting plate 13, the indoor air 19 abutting on the negative pressure surface side of the wind direction plate 13 produces condensation.

In order to prevent dew drop due to the condensation on the wind direction deflecting plate, it is necessary to implant fiber on the entire surface of the wind direction deflecting plate to provide water keeping capability. This leads to an increase in the production cost, and impairs the good appearance because smudges applied to the fiber cannot be removed.

A part of the blown-off cooled air flows along the outer bottom surface 4A of the decoration panel 4 while it involves the indoor air and increases the temperature. For this reason, the condensation occurring on the outer side of the blow-off opening portion is prevented in such a manner that the outer bottom surface 4A of the decoration panel 4 is not lowered to the dew point or lower. The ceiling, however, is necessarily cooled. Because of the minute condensation thus generated, the ceiling resulted in a wet state. This leads to a smudging phenomenon in which minute dust floating in the blown-off air flow is applied onto the ceiling.

Particularly, both ends of the wind direction deflecting plate 13 have to be shaped to conceal the inside of the blow-off opening portion 6 from the viewpoint of design. Both ends of the wind direction deflecting plate 13 and the wall of the blow-off opening portion 6 opposite thereto are caused to be adjacent to each other to the degree that they are not brought into contact with each other. As a result, the sufficient amount of wind cannot be assured so that the ambient indoor air 19 is likely to be involved, thereby necessarily generating condensation.

SUMMARY OF THE INVENTION

It is an object of the present invention to provide a wind direction adjusting device in which a wind speed can be uniform and the wind direction controllabity due to the wind deflecting plate can be improved even if the wind speed has non-uniform distribution in a wind path.

It is another object of the present invention to provide a wind direction adjusting device capable of preventing condensation on the wind direction deflecting plate and attendant dew drop therefrom, and condensation and application of smudges on the wall surface in the neighborhood of a blow-off opening portion and ceiling.

The wind direction adjusting device according to the present invention includes a wind speed uniforming unit provided upstream of a wind path having a nonuniform wind speed distribution from the side of high wind speed to the side of low wind speed, and a blow-off opening provided downstream of the wind path, which includes a wind direction deflecting plate for deflecting the blow-off direction of the blown-off wind. Further, the wind speed uniforming unit includes a deflecting guide provided on a wind path wall on the side of the high wind speed for deflecting blown-off wind toward a wind path center portion; a wind path wall portion on the side opposite deflecting guide, the shape of which is changed in accordance with the shape of the deflecting guide so that the sectional area of the wind path is substantially uniform; and an enlarged wind path portion provided immediately after the downstream side end portion of the deflecting guide, the enlarged wind path portion serving to return the blown-off wind from the wind path center portion to the wind path wall downstream the deflecting guide on the side of the deflecting guide.

In the wind direction adjusting device structured as described above, the flow at a high wind speed is deflected by the deflecting guide toward the center of the wind path. Then, the sectional area of the wind path is made substantially constant so that reduction in the amount of wind is prevented. The enlarged wind path portion immediately after the downstream side of the deflecting guide abruptly enlarges the sectional area of the wind path so that the flow is separated. The negative pressure area successive thereto applies again the flow to the wall surface on the side of the deflecting guide. For this reason, the wind speed in a section of the wind path can be uniformed, and the amount of wind can be uniformly distributed on both sides of the pressure and negative pressure sides of the wind direction deflecting plate. This improves the controllability of wind direction by the wind direction deflecting plate.

BRIEF DESCRIPTION OF THE DRAWINGS

In the accompanying drawings.

PREFERRED EMBODIMENTS OF THE INVENTION

The preferred embodiments of the present invention will be described referring to the accompanying drawings as follows.

Embodiment 1

Figure 1:
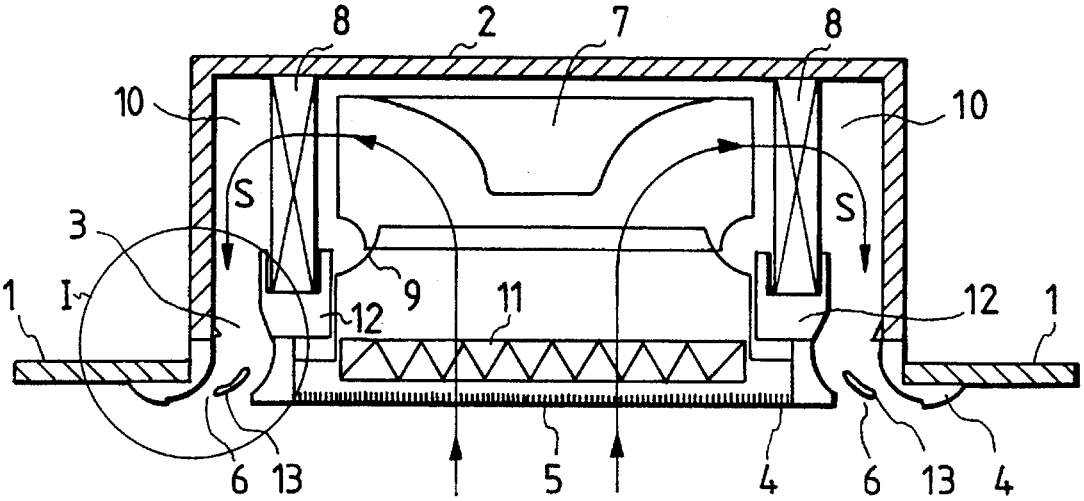
FIG. 1 is a longitudinal sectional view of an indoor unit of a ceiling embedded cassette type air conditioner according to an embodiment of the present invention.
Figure 2:
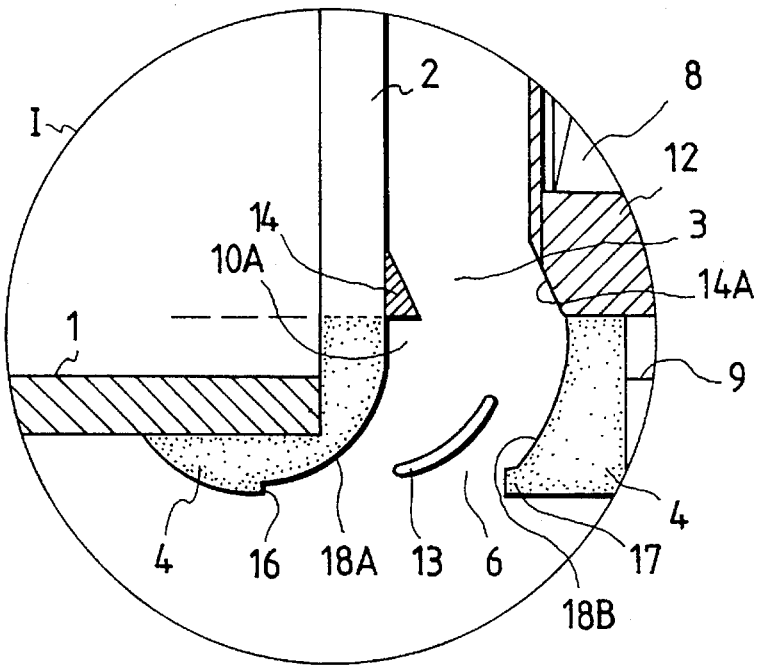
FIG. 2 is an enlarged view of a section I in FIG. 1.

An explanation will be given of one embodiment of the present invention. FIG. 1 is a longitudinal sectional view of an indoor unit of a ceiling embedded cassette type air conditioner. FIG. 2 is an enlarged view of section I in FIG. 1.

In these figures, a decoration panel 4 having a sucking opening portion 5 and blow-off opening portions 6 which are provided on the lower surface of a unit body 2. The sucking opening portions 5 and blow-off opening portions 6 are exposed below a ceiling 1, and the unit body 2 is embedded into the ceiling 1. A blower 7 is provided in the unit body 2. Between the blower 7 and the decoration panel 4 on the side of sucking opening portion 5, a bell mouth 9 and a filter 11 immediately beneath the bell mouth are arranged. On each of the blow-off sides of the blower 7, a heat exchanger 8 and a drain pan 12 are provided. Reference numeral 10 denotes one of wind paths for blow-off having a substantially square section extending from the heat exchanger 8 to the blow-off opening portion 6 of the decoration panel 4. Reference numeral 13 denotes one of wind-direction deflecting plates each having an arc section pivotally attached at both ends of the blow-off opening portion 6 and deflecting the blown-off air vertically. Reference numeral 14 denotes a deflecting guide of a triangular pillar which is provided at the opening portion 3 of the unit body 2 upstream of the wind direction deflecting plate 13. The wall opposed to the deflecting guide constitutes a drain pan 12 which is formed at the same angle as the deflecting guide 14 so that the sectional area of the wind path 10 is constant. This drain pan forms the wall 14A of the wind path opposed to the deflecting guide 14.

Immediately after the downstream side end of the deflecting guide 14, an enlarged wind path portion 10A where the wind path is abruptly enlarged is formed. A wind speed uniforming unit includes the deflecting guide 14, the wind path wall portion 14A opposed to the deflecting guide and the enlarged wind path portion 10.

A protrusion 17 is a first wind direction deflecting member protruding linearly toward the wind direction deflecting plate 13 at the lowest end of the inner wall 18B in the blow-off opening portion 6 of the decoration panel 4. The inner wall 18B in the blow-off opening portion 6 forms a gentle curve from its abutting face on the drain pan 12 to the protrusion 17.

A curved outer wall 18A of the blow-off opening portion starts from the downstream side of the deflecting guide 14 to the horizontal lower surface of the decoration panel 4 in the blow-off opening portion 6. A level difference 16 is a second wind deflecting member formed in the neighborhood of the lowest end of the outer wall 18A. The level difference 16 is arranged downstream of the wind deflecting plate 13. In this case, the wind direction deflecting plate 13 is located above the line connecting the level difference 16 to the protrusion 17 which is the first wind direction deflecting member.

An arrow (S) denotes the flow of air which is generated by the blower 7.

Figure 3:
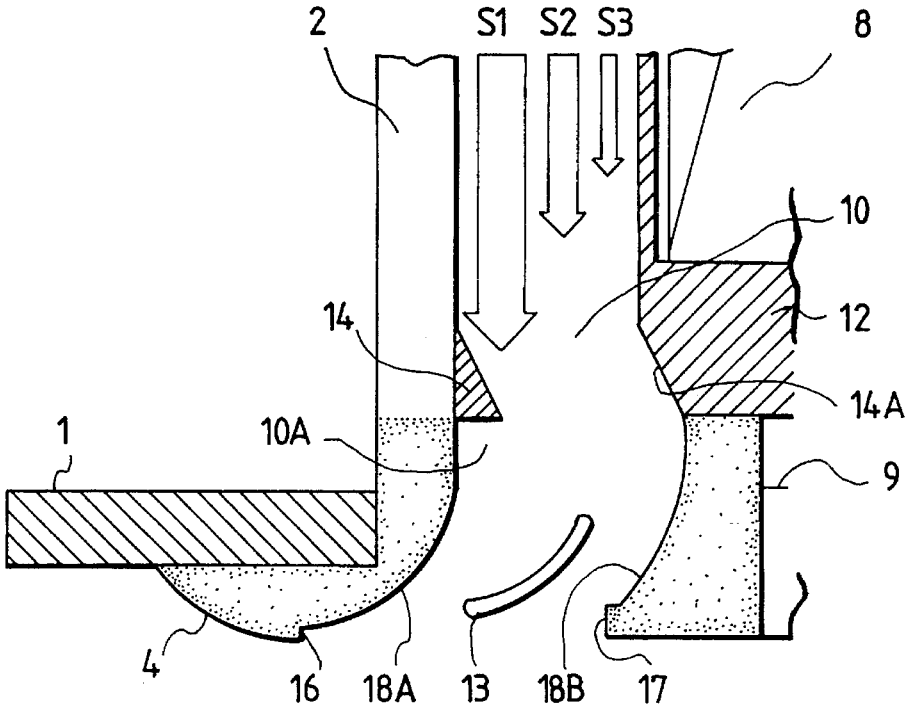
FIG. 3 is a schematic diagram showing the flow of the blown-off wind in a wind path of the ceiling embedded cassette type air conditioner according to an embodiment of the present invention.
Figure 4:
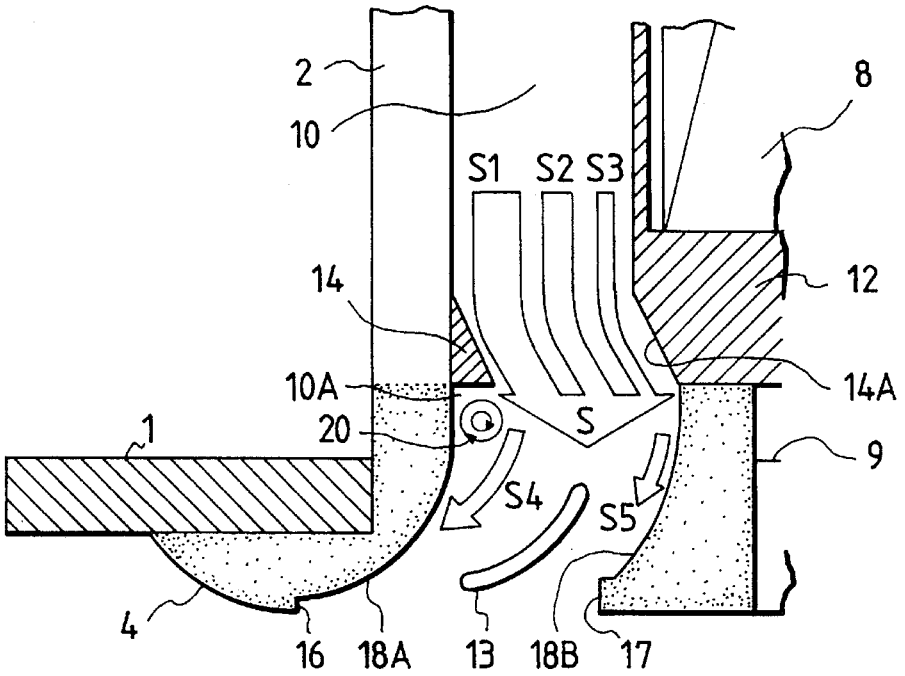
FIG. 4 is a schematic diagram showing the flow of the blown-off wind in a wind path of the ceiling embedded cassette type air conditioner according to an embodiment of the present invention.
Figure 5:
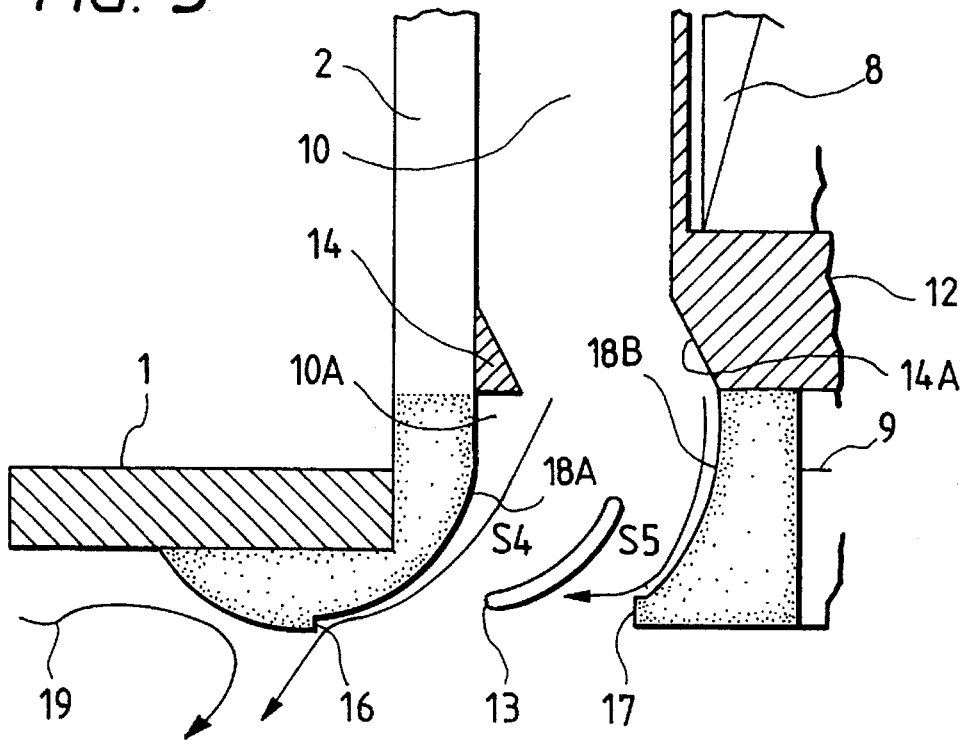
FIG. 5 is a schematic diagram showing the flow of the blown-off wind in the neighborhood of a blown-off opening portion of the ceiling embedded cassette type air conditioner according to an embodiment of the present invention.

An explanation will be given of the operation of the air conditioner in this embodiment. FIGS. 3 to 5 are schematic diagrams showing the flow of the blown-off wind in this embodiment. The blower 7 is driven so that the indoor air is sucked from the sucking opening portion 5. The sucked air is cooled or heated when it passes the heat exchanger 8. The wind is blown off from the blow-off opening portion 6 through the wind path 10. As shown in FIG. 1, an air flow (S) immediately after it passes through the heat exchanger 8 is deflected at right angles along the wind path 10, and the wind is subjected to the action of centrifugal force.

Consequently, in the opening 3 of the unit body 2, the wind speed distribution is not uniform such as S1>S2>S3 in which the wind speed on the more outer side is higher. The highest speed air flow S1 with holding the same speed distribution is gradually deflected towards the center of the wind path by the deflecting guide 14 provided on the wall and having a triangular section. In this case, a wind path wall portion 14A having the same slope as that of the deflecting guide 14 is provided on the wind path wall of the drain pan 12 opposite to the deflecting guide 14 so that the sectional area of the wind path 10 is constant to prevent the amount of wind from being reduced. The flow S1 deflected by the deflecting guide 14 is separated from the deflecting guide 14 by the enlarged wind path section 10A where the wind path sectional area at the bottom end of the wind deflecting guide 14 is abruptly enlarged. In this case, since a negative pressure zone 20 is generated immediately after the wind path guide 14, it promotes the above flow S1 to be applied again on the outer wall 18A. Thereafter, the flow S1 is merged with the flows of S2 and S3 so that the wind speed within the wind path 10 is uniformed. The flow S with the wind speed being thus uniformed reaches the wind direction deflecting plate 13 to deflect the wind direction vertically. The flow S also flows the outer wall 18A and the inner wall 18B in the blow-off opening portion 6. The flow S4 along the outer wall 18A is applied on a curved wall 18A because of the Coanda effect. The curved wall 18A continues from the downstream side of the deflecting guide 14 to the horizontal outer lower surface of the decoration panel 4 in the blow-off opening portion 6. The flow S4 is separated from the wall surface by the level difference 16 which is the second wind direction deflecting member at the position where the outer wall 18A is horizontal so that it is not applied on the ceiling. On the other hand, the flow S5 in the neighborhood of the inner wall 18B flows along the curve of the inner wall 18B so as to reach a protrusion 17 which is the first wind direction deflecting member at the lowest end of the inner wall 18B. This protrusion 17 deflects the flow S5 toward the negative pressure side of the wind direction deflecting plate 13 so that the blown-off wind is prevented from being separated from the negative pressure side of the wind deflecting plate 13.

In accordance with this embodiment, the wind speed uniforming unit including the deflecting guide in the wind path, the wind path wall section opposite to the deflecting guide and the enlarged wind path section uniforms the wind speed within the section of the wind path. Thus, the amount of wind is uniformly distributed on both sides of the pressure surface and the negative pressure surface of the wind direction deflecting plate. On the outer wall of the blow-off opening portion, the wind is stably separated by the curve of the outer wall and the level difference, and the wind is not applied to the ceiling. For this reason, the smudging phenomenon that smudges are applied on the ceiling can be prevented. On the inner wall of the blow-off opening portion, the wind flows along the curve of the inner wall to the protrusion at its lowest end which is the first wind direction deflecting member. This protrusion deflects the wind flow toward the negative pressure side of the wind direction deflecting plate so that the blown-off wind is not separated from the negative pressure side of the wind deflecting plate. Thus, the pressure surface and negative pressure surface of the wind direction deflecting plate abut on the blown-off flow at the same temperature so that condensation on the wind direction deflecting plate during cooling can be prevented.

Due to the prevention of condensation on the wind direction deflecting plate, it is not necessary to implant fiber into the wind direction which is the conventional member for preventing dew drop. This permits the production cost to be reduced and smudges to be easily removed.

Incidentally, in FIGS. 1 to 6, the deflecting guide 14 has a triangular section, but its shape should be not limited to such a shape. As long as the deflecting guide deflects the flow toward the wind path center portion and thereafter forms the negative pressure zone, a protrusion protruding from the wall surface to the wind path center portion may be used. However, the shape of the deflecting guide may preferably provide the slope which gradually deflects the flow at a high speed and the abruptly enlarging portion which returns the flow using the negative pressure zone created when the flow is separated. In this meaning, the deflecting guide is desired to have a triangular section, a section having a curved slope as shown in FIG. 7A, and a section having a slope cut at the lowest end as shown in FIG. 7B. Particularly, the shape shown in FIG. 7B has an advantage that it can be easily fabricated.

Figure 8:
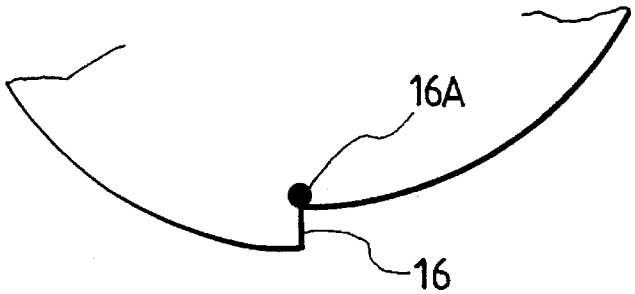
FIG. 8 is a view showing the level difference portion of the ceiling embedded cassette type according to an embodiment of the present invention.

As described above, the level difference 16 provided at the outer wall 18A permits the flow to be separated from the wall, thereby preventing condensation on the ceiling and the smudging phenomenon. In this case, if an auxiliary heater 16A is provided at the level difference portion as shown in FIG. 8, the wall surface outside the level difference and the ceiling will not be entirely cooled, thus making it more sure to prevent condensation and smudging phenomenon.

The auxiliary heater 16A may be controlled so as to be actuated by a sensor capable of measuring indoor humidity installed in the indoor unit when the humidity exceeds a predetermined value. Consequently, the electric power consumed by the heater can be saved.

Figure 6:
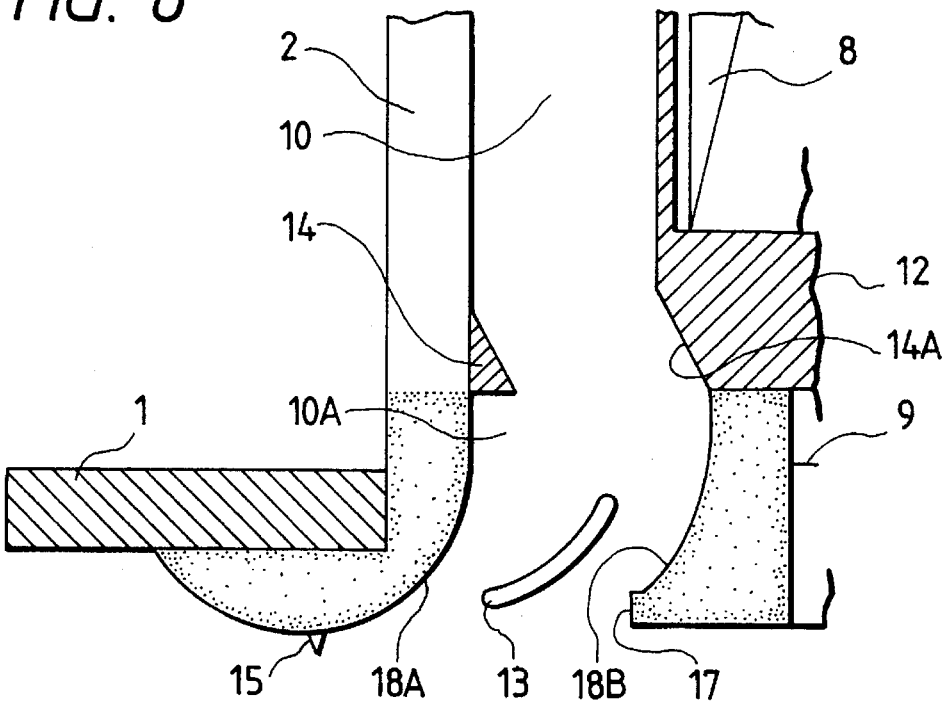
FIG. 6 is a longitudinal sectional view of the neighborhood of a blown-off opening portion of the ceiling embedded cassette type air conditioner according to an embodiment of the present invention.
Figure 7A:
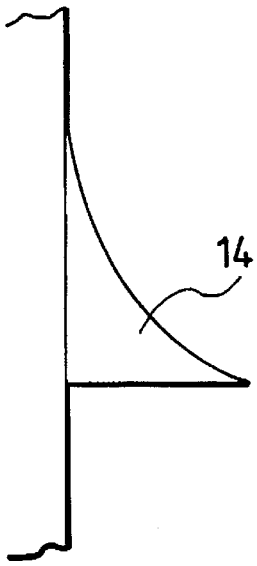
FIGS. 7A and 7B are views showing the shape of the deflecting guide in the wind path of the ceiling embedded cassette type air conditioner according to alternate embodiments of the present invention.
Figure 7B:
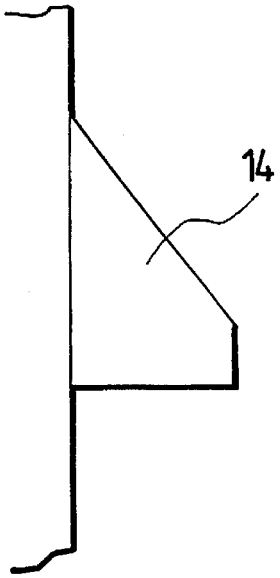

In this embodiment, although the level difference 16 is provided at the end of the curve of the outer wall 18A in the blown-off opening portion 6, a projection 15 as shown in FIG. 6 can attain the same effect.

Embodiment 2

Figure 9:
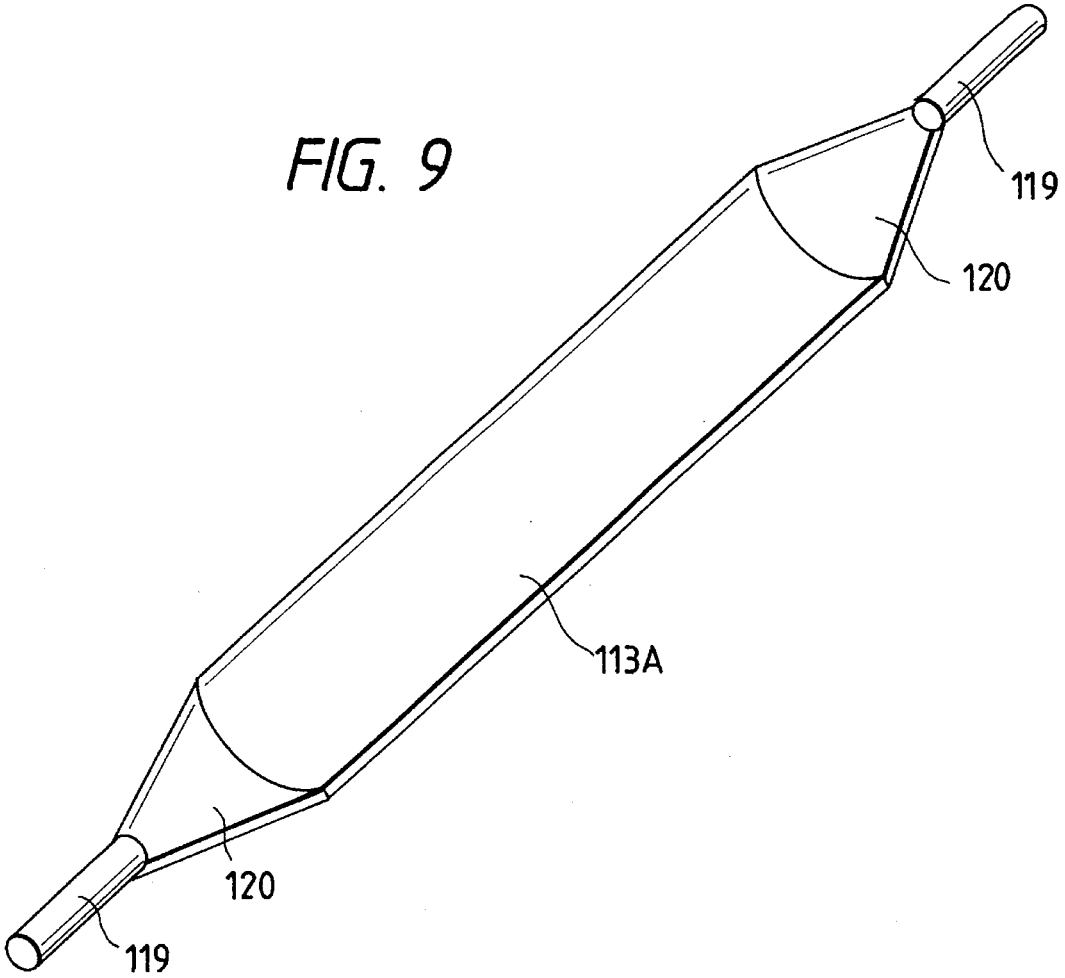
FIG. 9 is a perspective view of the wind deflecting plate according to another embodiment of the present invention.
Figure 10A:
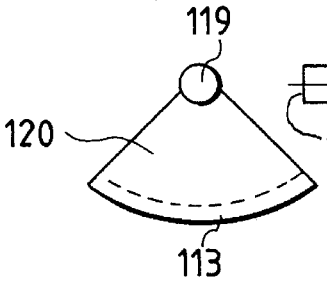
FIGS. 10A and 10B are side view and a front view of the wind direction deflecting plate according to another embodiment of the present invention.
Figure 10B:
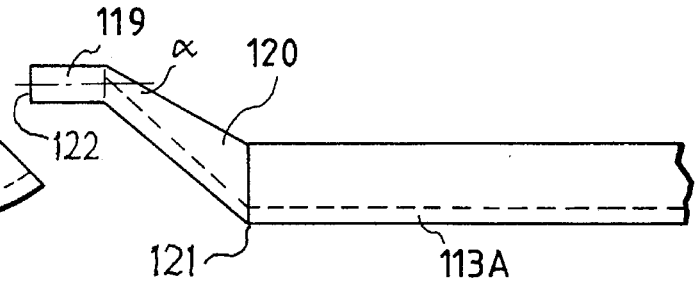
Figure 11:
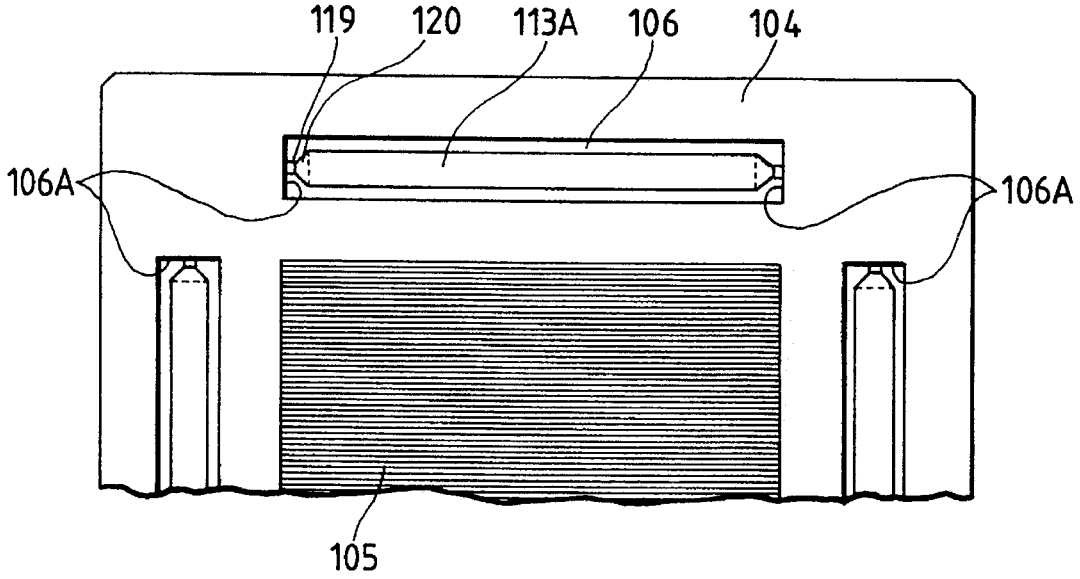
FIG. 11 is a bottom view of the decoration panel of a ceiling embedded cassette type air conditioner according to another embodiment of the present invention.
Figure 12:
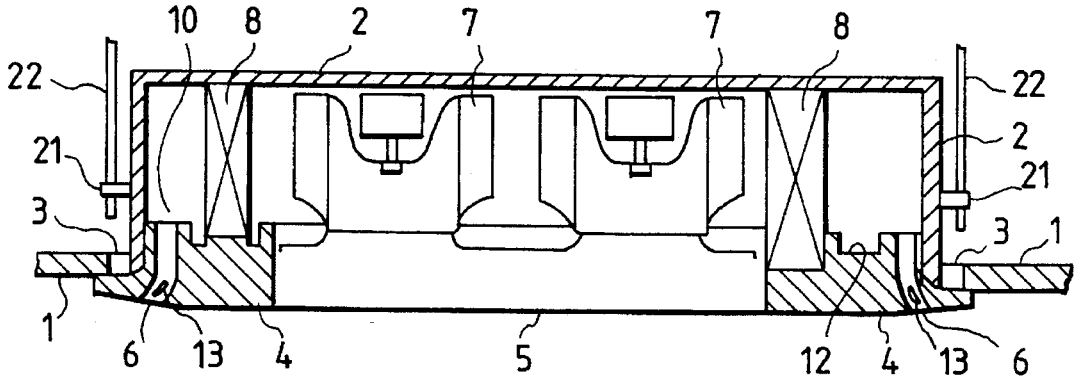
FIG. 12 PRIOR ART
FIG. 12 is a longitudinal sectional view of an indoor unit of the conventional ceiling embedded cassette type air conditioner.
Figure 13:
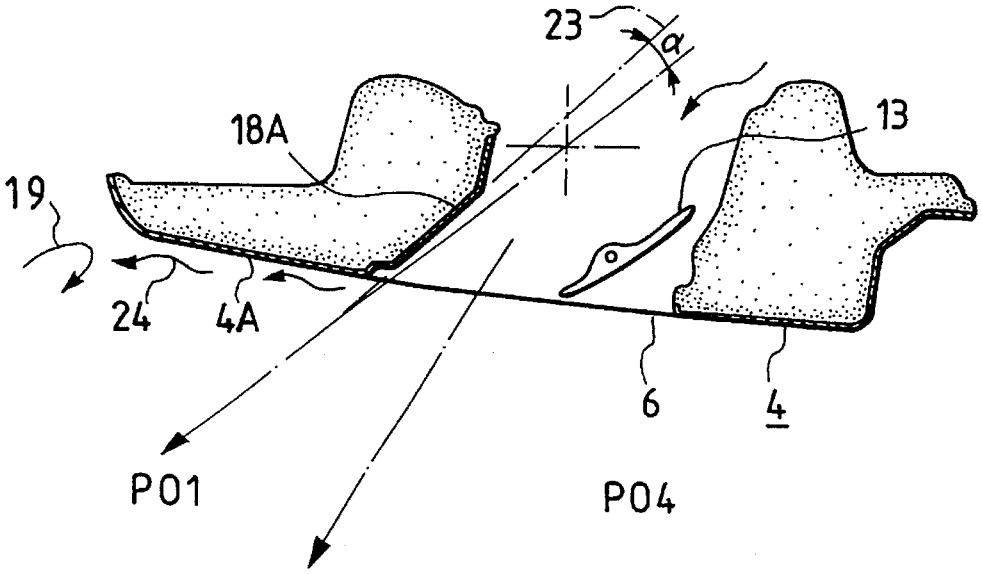
FIG. 13 PRIOR ART
FIG. 13 is an enlarged longitudinal sectional view of the conventional ceiling embedded cassette type air conditioner.
Figure 14:
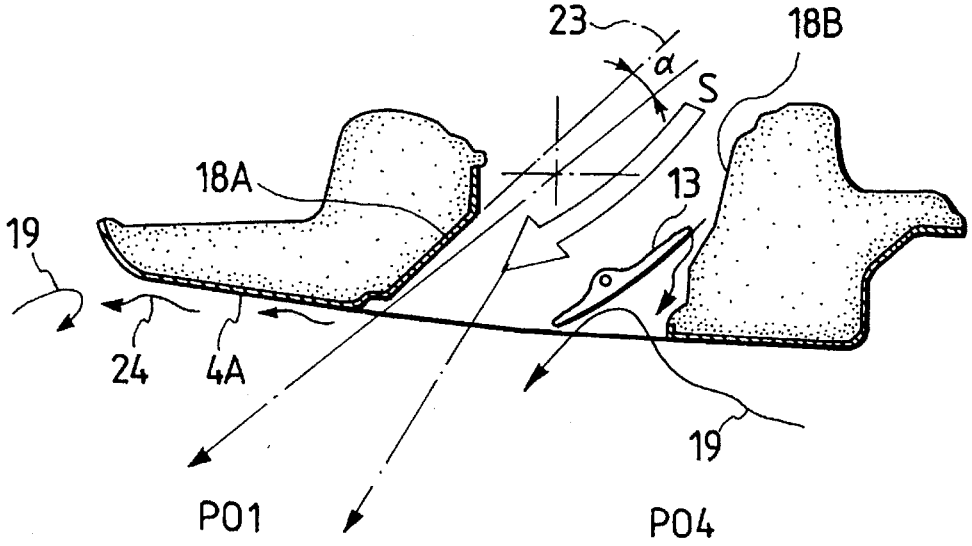
FIG. 14 PRIOR ART
FIG. 14 is a schematic view showing the air flow in the neighborhood of the blow-off opening portion of the conventional ceiling embedded cassette type air conditioner.

The above embodiment relates to the structure of the blow-off opening portion 106 for preventing condensation on the wind direction deflecting plate 113 due to the control of blown-off air in the cross section of the wind path 110. However, it is also necessary to prevent condensation on both ends of the wind direction deflecting plate 113. FIGS. 9 to 11 are views showing the wind direction deflecting plate according to another embodiment of the present invention. Specifically, FIG. 9 is a perspective view of the wind direction deflecting plate, FIG. 10 is a side view and a front view of the wind direction deflecting plate, and FIG. 11 is a bottom view of the decoration panel of a ceiling embedded cassette type air conditioner.

In these figures, a wind direction deflecting plate 113A has a section of an arc shape for deflecting the blown-off air vertically. A rotary shaft 119 deflects the wind direction by rotating the wind direction deflecting plate 113A. The rotary shaft 119 is located at the position eccentric from the wind direction deflecting plate 113A and axially outwardly from the end thereof. A supporting plate 120 extends at an acute angle $\alpha$ to the rotary axis 122 of the rotary shaft 119 and communicates the wind direction deflecting plate 113A with the rotary shaft 119. The supporting plate 120 has a width gradually decreasing from the width of the wind direction deflecting plate 113A to that of the rotary shaft 113A.

In such a structure, even when the wind direction deflecting plate 113A constitutes large drafting resistance in the wind path 110 because it is inclined substantially horizontally during the horizontal blow-off, the blown-off air flow is sufficiently supplied to the portion where the width of the supporting plate 120 is gradually decreased. Thus, during cooling, both ends of the wind direction deflecting plate 113 and the supporting plate 120 are brought into contact with the blown-off air. For this reason, the ambient indoor air is not involved so that condensation on these portions can be prevented. Due to the prevention of condensation on both ends of the wind direction deflecting plate, it is not necessary to implant fiber onto the wind direction deflecting plate which is the conventional member for preventing dew drop. This permits the production cost to be reduced and smudge to be easily removed.

Since the width of the supporting plate 120 decreases gradually from that of wind direction deflecting plate 113A to the diameter of the rotary shaft 119, the inside of the blow-off opening portion can be concealed, thereby not impairing the appearance in design.

Incidentally, in this embodiment, the section of the wind direction deflecting plate was an arc-shaped. However, it is needless to say that the wind direction deflecting plate having a plate-like shape can also attain the same effect.

It goes without saying that the wind direction deflecting plate in this embodiment can be applied to the wind blow-off device in the first embodiment of the present invention so that the wind direction adjusting device having both functional advantages of the first and second embodiments is completed.

Although, in the first and second embodiments, the present invention is applied to the ceiling embedded cassette type air conditioner, the present invention can be widely used as a blow-off opening portion of each of a ceiling type air conditioner, shelf-type air conditioner (inclusive of a room air conditioner) and a floor type air conditioner.

The present invention, which is structured as described above, has the following meritorious effects described below.

The wind speed uniforming unit is provided upstream of the wind path having non-uniform distribution of the wind speed, and the blow-off opening portion having a wind direction deflecting plate is provided downstream of the wind path. Therefore, the wind speed in the section of the wind path can be uniformed, and the amount of wind can be uniformly distributed on both sides of the pressure and negative pressure sides of the wind direction deflecting plate. Consequently, the controllability of wind direction can be improved by the wind direction deflecting plate.

The first wind direction deflecting member deflects the flow along the curved wind path wall toward the negative pressure side of the wind direction deflecting plate to suppress separation of the blown-off wind on the negative pressure side of the wind direction deflecting plate, thereby preventing condensation on the wind direction deflecting plate during cooling. Accordingly, it is not necessary to implant fiber into the wind direction deflecting plate, thereby permitting the production cost to be reduced and preventing the good appearance to be impaired due to application of smudge.

Further, the second wind deflecting member separates the air flow applied to the curved wall therefrom having a shape gradually enlarging toward the outside of the blow-off opening portion due to the Coanda effect. Accordingly, the air flow is not applied on the ceiling. Therefore, minute condensation on the ceiling and the smudging phenomenon that smudge is applied to the ceiling can be prevented.

Since the deflecting guide forms the wall gradually sloping toward the center of the wind path from upstream of the wind path to downstream thereof when the wind at a high speed is deflected toward the center of the wind path, it can be smoothly deflected without an increase in blowing resistance, thereby not stirring the flow. The sectional area of the wind path immediately after the deflecting guide can be abruptly enlarged so that the air flow can be easily separated. Because of a large negative pressure on the above separation area promotes the re-application of flow thereon and uniforming of the wind speed within the section in the wind path. As a result, the controllability of the blown-off wind due to shape of the blow-off opening portion and wind direction deflecting plate can be improved, and smudging and condensation on the wind direction deflecting plate can be completely prevented.

Since the second wind direction deflecting member is a level difference provided on the curved wall, the blown-off air flow applied to the wall due to the Coanda effect can be effectively separated. This prevents, the smudging phenomenon, i.e., the blown-off air flow from being applied to the ceiling, without impairing the good appearance in design.

The wind direction deflecting plate is formed as a plate having a substantially arc shape in its section and having such a shape that its rotary shaft is located at a position eccentric from the plate and both ends of the plate in the direction of the rotary shaft have a gradually decreasing width to the rotary shaft. For this reason, the inside of the blow-off opening portion can be concealed, thereby not impairing the appearance in design. The blown-off air flow can also be led to both ends of the wind direction deflecting plate, thereby preventing condensation on both ends. This makes it unnecessary to implant fiber into the wind direction which is the conventional member for preventing dew drop, thus permitting the production cost to be reduced and smudge to be easily removed.

What is claimed is:

1. A wind direction adjusting device comprising:

a wind speed uniforming means provided upstream of a wind direction deflecting plate located in a wind path having a nonuniform wind speed distribution from the side of high wind speed to the side of low wind speed, said wind speed uniforming means including:

a deflecting guide provided on a wind path wall on the side of the high wind speed for deflecting blown-off wind toward a wind path center portion, said deflecting guide terminating abruptly in a downstream side end portion at a location upstream of said wind direction deflecting plate;

a wind path wall portion on the side opposite to the deflecting guide, the shape of which is changed in accordance with the shape of said deflecting guide so that the sectional area of the wind path is substantially uniform; and an enlarged wind path portion provided immediately after the downstream side end portion of said deflecting guide, said enlarged wind path portion serving to return the blown-off wind from the wind path center portion to the wind path wall downstream said deflecting guide on the side of said deflecting guide; and a blow-off opening provided downstream of the wind path, said wind direction deflecting plate positioned adjacent said blow-off opening for deflecting the blow-off direction of the blown-off wind.

2. A wind direction adjusting device according to claim 1, said wind path has a square-shaped section, and said deflecting guide on said wind path wall has a sloped wall gradually extending to the center of said wind path from upstream of the wind path toward downstream thereof.

3. A wind direction adjusting device comprising:

a wind speed uniforming means provided upstream of a wind direction deflecting plate located in a wind path having a nonuniform wind speed distribution from the side of high wind speed to the side of low wind speed, said wind speed uniforming means including:

a deflecting guide provided on a wind path wall on the side of the high wind speed for deflecting blown-off wind toward a wind path center portion;

a wind path wall portion on the side opposite to the deflecting guide, the shape of which is changed in accordance with the shape of said deflecting guide so that the sectional area of the wind path is substantially uniform; and an enlarged wind path portion provided immediately after a downstream side end portion of said deflecting guide, said enlarged wind path portion serving to return the blown-off wind from the wind path center portion to the wind path wall downstream said deflecting guide on the side of said deflecting guide;

a blow-off opening provided downstream of the wind path, said wind direction deflecting plate positioned adjacent said blow-off opening for deflecting the blow-off direction of the blown-off wind;

an inner side wall provided on a side opposite to said deflecting guide, said inner side wall having a curved surface which goes from a position opposite to the downstream side end portion of said deflection guide toward the wind path center portion;

first wind direction deflecting means for deflecting an air flow along said inner side wall toward a negative pressure side of said wind direction deflecting plate, said first wind direction deflecting means being provided at a tip of said inner side wall and extending toward the negative pressure side of said wind direction deflecting plate;

an outer side wall provided downstream of said deflecting guide, said outer side wall having a curved surface enlarged gradually towards the outside of said blow-off opening portion; and a second wind direction means for separating an air flow along said outer side wall therefrom, said second wind direction means being provided on said outer side wall.

4. A wind direction adjusting device according to claim 3, wherein said second wind direction means is provided at substantially the lowest end of said outer side wall.

5. A wind direction adjusting device according to claim 3, said wind path has a square-shaped section, and said deflecting guide on said wind path wall has a sloped wall gradually extending to the center of said wind path from upstream of the wind path toward downstream thereof.

6. A wind direction adjusting device according to claim 3, wherein said wind path has a square-shaped section, and said second wind direction deflecting means is a level difference provided on said curved wall surface.

7. A wind direction adjusting device according to claim 3, further comprising heating means for heating said second wind direction deflecting means and around said second wind direction deflecting means.

8. A wind direction adjusting device according to claim 3, wherein said second wind direction deflecting means is provided downstream side of said wind deflecting plate.

9. A wind direction adjusting device according to claim 8, wherein said wind direction deflecting plate is located above the line connecting said first wind direction deflecting means to said second wind direction deflecting means.

10. A wind direction adjusting device comprising:

a blow-off opening portion for blowing off wind, said blow-off opening portion being provided downstream of a wind path having a square shape; and a wind direction deflecting plate provided adjacent said blow-off opening portion, said wind direction deflecting plate including:

a wind direction deflecting plate body for deflecting the blown-off air;

a rotary shaft mounted for rotation about a rotary axis for deflecting the wind direction by rotating the wind direction deflecting plate; said rotary shaft being located at the position eccentric from said wind direction deflecting plate and spaced axially outwardly of an end of said wind direction deflecting plate; and a supporting plate extending at an acute angle to said rotary axis communicating said wind direction deflecting plate with said rotary shaft, said supporting plate having a width gradually decreasing from a width of said wind direction deflecting plate to a width of the rotary shaft.

11. A wind direction adjusting device according to claim 10, wherein said wind direction deflecting plate body has a section of an arc shape.

12. A wind direction adjusting device according to claim 10, wherein said wind direction deflecting plate body is flat.

* * * * *